US010569123B2

(12) United States Patent
Hochstrasser et al.

(10) Patent No.: US 10,569,123 B2
(45) Date of Patent: Feb. 25, 2020

(54) DECK ADJUSTMENT INTERFACE

(71) Applicant: ICON Health & Fitness, Inc., Logan, UT (US)

(72) Inventors: Ryan Hochstrasser, Hyrum, UT (US); William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 117 days.

(21) Appl. No.: 15/830,255

(22) Filed: Dec. 4, 2017

(65) Prior Publication Data

US 2018/0154207 A1 Jun. 7, 2018

Related U.S. Application Data

(60) Provisional application No. 62/429,963, filed on Dec. 5, 2016.

(51) Int. Cl.

| | |
|---|---|
| ***A63B 22/00*** | (2006.01) |
| ***A63B 24/00*** | (2006.01) |
| ***A63B 71/06*** | (2006.01) |
| ***A63B 22/02*** | (2006.01) |

(52) U.S. Cl.

CPC ..... *A63B 22/0023* (2013.01); *A63B 22/025* (2015.10); *A63B 24/0087* (2013.01); *A63B 71/0622* (2013.01)

(58) Field of Classification Search

None

See application file for complete search history.

(56) References Cited

U.S. PATENT DOCUMENTS

| | | | | |
|---|---|---|---|---|
| 3,368,746 | A | 2/1968 | Zelinski | |
| 4,788,493 | A | 11/1988 | Liptak | |
| 5,154,684 | A | 10/1992 | Delf | |
| 5,163,885 | A * | 11/1992 | Wanzer | A63B 22/02 482/54 |
| 5,295,927 | A | 3/1994 | Easley | |
| 5,782,639 | A * | 7/1998 | Beal | A63B 71/0622 434/29 |
| 5,820,478 | A * | 10/1998 | Wood | A63B 69/3652 473/279 |
| 6,558,299 | B1 | 5/2003 | Slattery | |
| 6,945,912 | B2 * | 9/2005 | Levi | A63B 22/0023 482/54 |
| 7,060,006 | B1 * | 6/2006 | Watterson | A63B 22/0235 482/54 |
| 7,645,213 | B2 * | 1/2010 | Watterson | A63B 24/0084 482/1 |
| 7,682,291 | B2 * | 3/2010 | Gill | A63B 22/02 482/51 |

(Continued)

*Primary Examiner* — Stephen R Crow

(74) *Attorney, Agent, or Firm* — Ray Quinney & Nebeker

(57) ABSTRACT

A treadmill includes an exercise deck. The exercise deck includes a platform, a first pulley incorporated into the platform at a front end, a second pulley incorporated into the platform at a rear end, a tread belt surrounding the first pulley and the second pulley, and a plurality of tilt actuators incorporated into the platform. The treadmill also includes an upright structure. The upright structure includes a console, a tilt controller incorporated into the console in communication with the plurality of tilt actuators, and the tilt controller having a multi-dimensional input mechanism.

20 Claims, 13 Drawing Sheets

(56) References Cited

U.S. PATENT DOCUMENTS 7,789,800 B1 * 9/2010 Watterson ..... A63B 21/005
7,927,251 B1 * 4/2011 Porszasz ..... A61B 5/0833 482/1
7,981,000 B2 * 7/2011 Watterson ..... A63B 24/0084 482/1
8,315,823 B2 * 11/2012 Berme ..... G01L 25/00 702/101
8,615,377 B1 12/2013 Yuen et al.
8,617,008 B2 12/2013 Marty et al.
8,622,747 B2 1/2014 Chu et al.
8,647,240 B2 2/2014 Heidecke
8,651,030 B2 2/2014 Coffman
8,655,004 B2 2/2014 Prest et al.
8,657,724 B2 2/2014 Yang
8,671,853 B2 3/2014 Flaherty
8,678,897 B2 3/2014 Englert et al.
8,690,578 B1 4/2014 Nusbaum et al.
8,690,735 B2 * 4/2014 Watterson ..... A63B 24/0084 482/1
8,690,738 B1 4/2014 Astilian
8,701,567 B1 4/2014 Esfandiari et al.
8,702,430 B2 4/2014 Dibenedetto et al.
8,702,567 B2 4/2014 Hu
8,706,530 B2 4/2014 Ohnemus et al.
8,708,870 B2 4/2014 Nalley
8,714,346 B2 5/2014 Jens
8,727,946 B2 5/2014 Greenhill et al.
8,727,947 B2 5/2014 Tagliabue
8,734,157 B1 5/2014 Hummel, III
8,734,301 B2 5/2014 Remelius
8,734,302 B2 5/2014 Hsieh
8,738,321 B2 5/2014 Yuen et al.
8,739,974 B2 6/2014 TeVault et al.
8,740,756 B2 6/2014 Shabodyash et al.
8,749,380 B2 6/2014 Vock et al.
8,758,201 B2 * 6/2014 Ashby ..... A63B 21/005 482/8
8,762,077 B2 6/2014 Redmond
8,762,101 B2 6/2014 Yuen et al.
8,764,609 B1 7/2014 Elahmadie
8,777,820 B2 7/2014 Lo
8,783,326 B1 7/2014 Vaninger et al.
8,784,270 B2 * 7/2014 Ashby ..... A63B 21/005 482/8
8,784,274 B1 7/2014 Chuang
8,786,575 B2 7/2014 Miller
8,790,222 B2 * 7/2014 Burger ..... A63B 21/0087 482/51
9,586,090 B2 * 3/2017 Watterson ..... A63B 24/0087
9,616,278 B2 * 4/2017 Olson ..... A63B 22/0023
10,004,656 B2 * 6/2018 Whalen ..... A63B 21/00181
2003/0073552 A1 * 4/2003 Knight ..... A47C 7/024 482/148
2004/0204296 A1 * 10/2004 Maenpaa ..... A63B 22/0023 482/54
2012/0220427 A1 * 8/2012 Ashby ..... A63B 22/0023 482/4
2014/0221167 A1 * 8/2014 Wu ..... A63B 22/0023 482/54
2014/0274564 A1 * 9/2014 Greenbaum ..... A63B 24/0087 482/5
2014/0336010 A1 * 11/2014 Burger ..... A63B 21/0087 482/54
2015/0238817 A1 * 8/2015 Watterson ..... A63B 22/0023 482/8
2016/0250519 A1 * 9/2016 Watterson ..... G06F 16/29 482/4
2018/0001135 A1 * 1/2018 Powell ..... A63B 21/154
2018/0036585 A1 * 2/2018 Powell ..... A63B 21/154
2018/0099205 A1 * 4/2018 Watterson ..... A63B 71/0619
2018/0117419 A1 * 5/2018 Jackson ..... A63B 22/025
2019/0099320 A1 * 4/2019 Whalen ..... A63B 21/00181

* cited by examiner

DECK ADJUSTMENT INTERFACE

RELATED APPLICATIONS

This application claims priority to U.S. patent application Ser. No. 62/429,963 titled "Deck Adjustment Interface" and filed on 5 Dec. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include ellipticals, rowing machines, stepper machines, and stationary bikes to name a few.

One type of treadmill is disclosed in U.S. Patent Publication No. 2012/0220427 issued to Darren C. Ashby, et al. In this reference, an exercise system includes one or more exercise devices that communicate via a network with a communication system. The communication system stores and/or generates exercise programming for use on the exercise device. The exercise programming is able to control one or more operating parameters of the exercise device to simulate terrain found at a remote, real world location. The exercise programming can include images/videos of the remote, real world location. The control signals and the images/videos can be synchronized so that a user of the exercise device is able to experience, via the changing operating parameters, the topographical characteristics of the remote, real world location as well as see images of the location. Another type of treadmill is described in U.S. Patent Publication No. 2009/0209393 issued to Bradley A. Crater, et al.

SUMMARY

In one embodiment, a treadmill includes an exercise deck. The exercise deck includes a platform, a first pulley incorporated into the platform at a front end, a second pulley incorporated into the platform at a rear end, a tread belt surrounding the first pulley and the second pulley, and a plurality of tilt actuators incorporated into the platform. The treadmill also includes an upright structure. The upright structure includes a console, a tilt controller incorporated into the console in communication with the plurality of tilt actuators, and the tilt controller includes a multi-dimensional input mechanism.

The multi-dimensional input mechanism may include a joy stick.

The treadmill may also include a processor and memory. The memory may include programmed instructions that, when executed, cause the processor to interpret a multi-dimensional input into a corresponding tilt orientation of the exercise deck.

The programmed instructions, when executed, may cause the processor to activate at least one of the tilt actuators to position the exercise deck into the corresponding tilt orientation.

The multi-dimensional inputs may include sections that correspond to portions of the exercise deck where the programmed instructions, when executed, cause the processor to change the orientation of the exercise deck when the tilt controller receives an input in the corresponding section.

The corresponding portion of the exercise deck may be reoriented by extending at least one of the plurality of tilt actuators and by retracting at least one of the plurality of tilt actuators.

The multi-dimensional inputs may include a front left quadrant, a front right quadrant, a rear left quadrant, and a rear right quadrant.

The plurality of tilt actuators may control an elevation of a front left portion of the exercise deck, a front right portion of the exercise deck, a rear left portion of the exercise deck, and a rear right portion of the exercise deck.

At least one of the plurality of tilt actuators may be a linear actuator.

The multi-dimensional input mechanism may include a touch screen.

The multi-dimensional input mechanism may have a 360 degree range.

The treadmill may include a curved screen incorporated into the console.

The multi-dimensional input mechanism may be incorporated into the curved screen.

In one embodiment, a treadmill includes an exercise deck. The exercise deck includes a platform, a first pulley incorporated into the platform at a front end, a second pulley incorporated into the platform at a rear end, a tread belt surrounding the first pulley and the second pulley, and a plurality of tilt actuators incorporated into the platform. The treadmill includes an upright structure. The upright structure includes a console, a tilt controller incorporated into the console, and the tilt controller having a multi-dimensional input mechanism. The treadmill also includes a processor and memory. The memory includes programmed instructions that, when executed, cause the processor to interpret a multi-dimensional input into a corresponding tilt orientation of the exercise deck and activate at least one of the tilt actuators to position the exercise deck into the corresponding tilt orientation.

The multi-dimensional inputs may include sections that correspond to portions of the exercise deck wherein the programmed instructions, when executed, cause the processor to change the angle of the exercise deck when the tilt controller receives an input in the corresponding arc segment.

The corresponding portion of the exercise deck may be reoriented by extending at least one of the plurality of tilt actuators and by retracting at least one of the plurality of tilt actuators.

The multi-dimensional inputs may include a front left quadrant, a front right quadrant, a rear left quadrant, and a rear right quadrant.

The plurality of tilt actuators may control an elevation of a front left portion of the exercise deck, a front right portion of the exercise deck, a rear left portion of the exercise deck, and a rear right portion of the exercise deck.

The treadmill may include a curved screen incorporated into the console and the multi-dimensional input mechanism is incorporated into the curved screen.

In one embodiment, a treadmill includes an exercise deck. The exercise deck includes a platform, a first pulley incorporated into the platform at a front end, a second pulley incorporated into the platform at a rear end, a tread belt surrounding the first pulley and the second pulley, and a plurality of tilt actuators incorporated into the platform. The treadmill also includes an upright structure. The upright structure includes a console, a curved screen incorporated into the console, a tilt controller incorporated into the curved screen, the tilt controller having a multi-dimensional input mechanism, wherein the multi-dimensional input mechanism includes arc segments that correspond to portions of the exercise deck. The treadmill includes a processor and memory. The memory includes programmed instructions that, when executed, cause the processor to interpret a multi-dimensional input into a corresponding tilt orientation of the exercise deck and activate at least one of the tilt actuators to position the exercise deck into the corresponding tilt orientation by elevating the portion of the exercise deck when the tilt controller receives an input in the corresponding arc segment. The corresponding portion of the exercise deck is reoriented by extending at least one of the plurality of tilt actuators and by retracting at least one of the plurality of tilt actuators.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
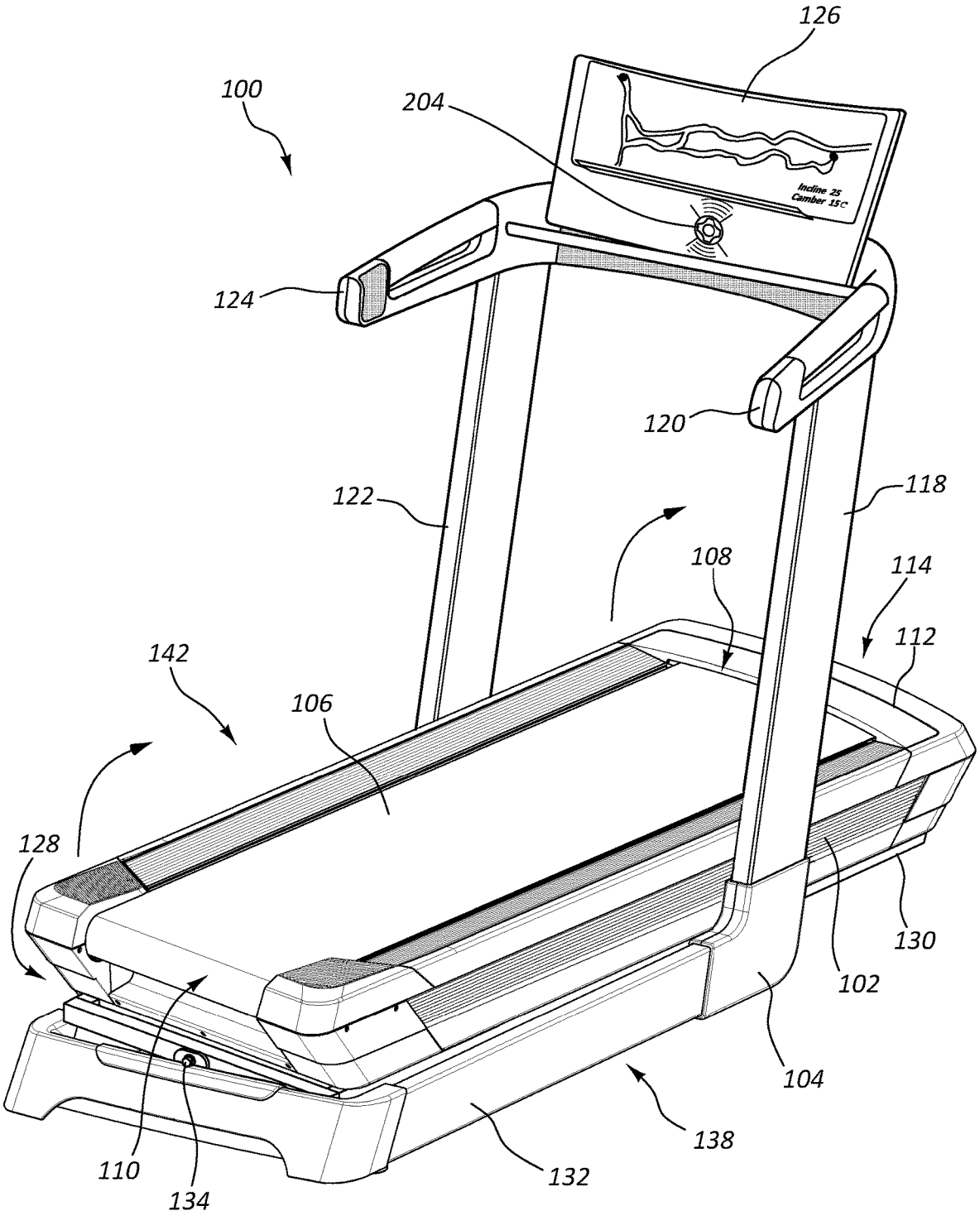
FIG. 1 illustrates a perspective view of an example of a treadmill in accordance with the present disclosure.
Figure 2:
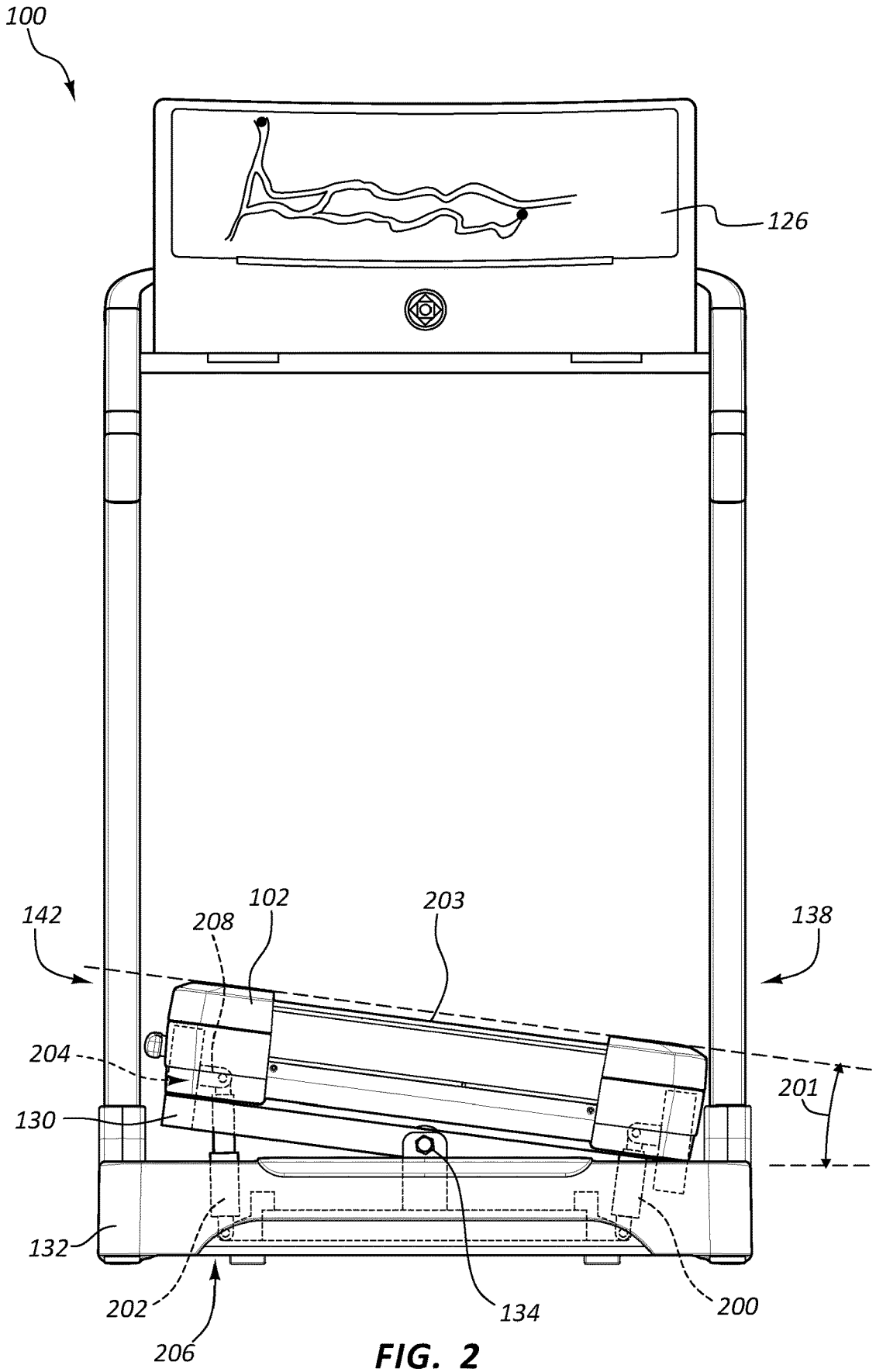
FIG. 2 illustrates a rear view of the treadmill depicted in FIG. 1 with a running deck laterally tilted to a first side.
Figure 3:
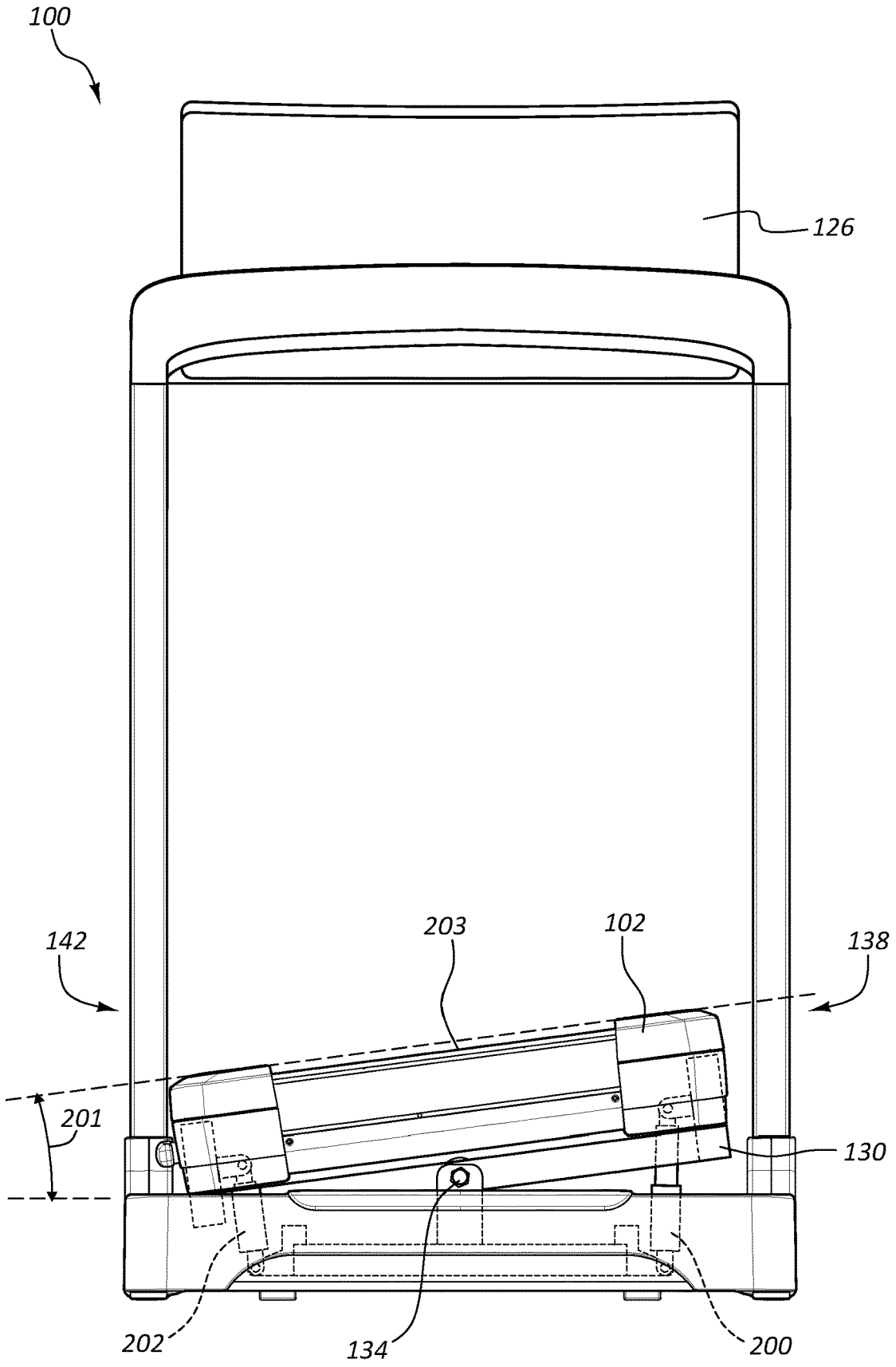
FIG. 3 illustrates a rear view of the treadmill depicted in FIG. 1 with a running deck laterally tilted to a second side.
Figure 4:
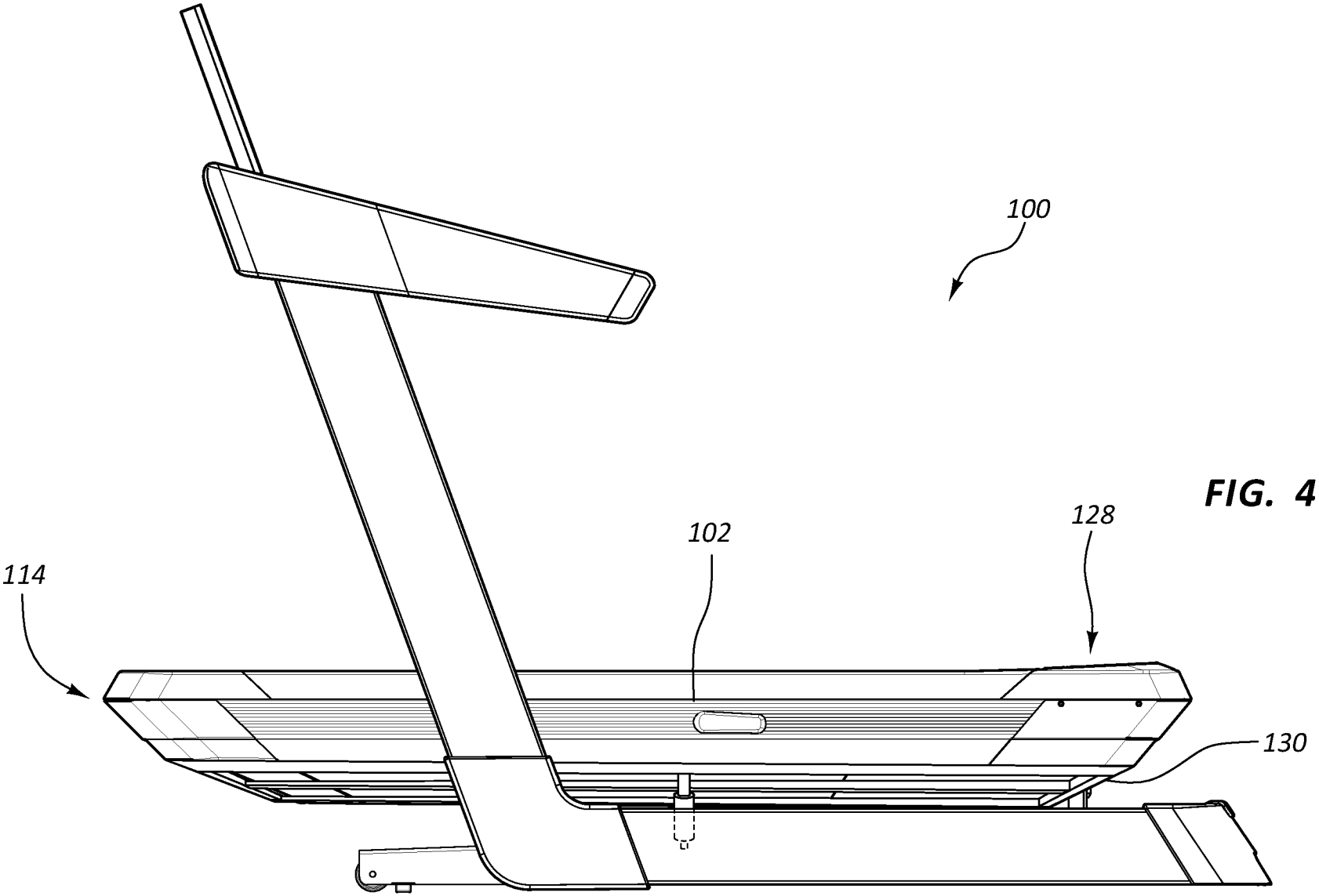
FIG. 4 illustrates a side view of the treadmill depicted in FIG. 1 with a running deck laterally tilted to a first side.
Figure 5:
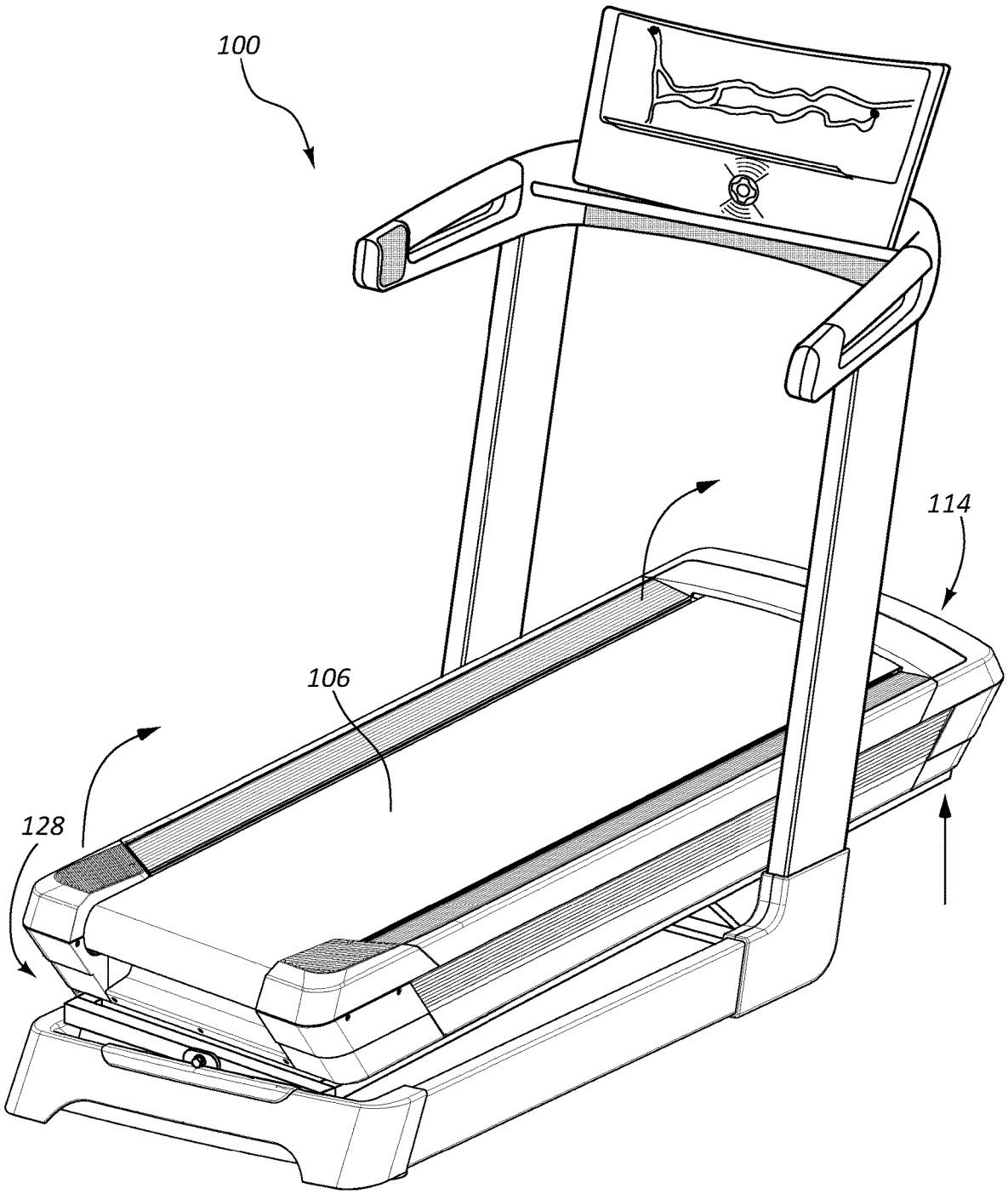
FIG. 5 illustrates a rear perspective view of the treadmill depicted in FIG. 1 with a running deck laterally tilted to a side and a front portion of the deck elevated.
Figure 6:
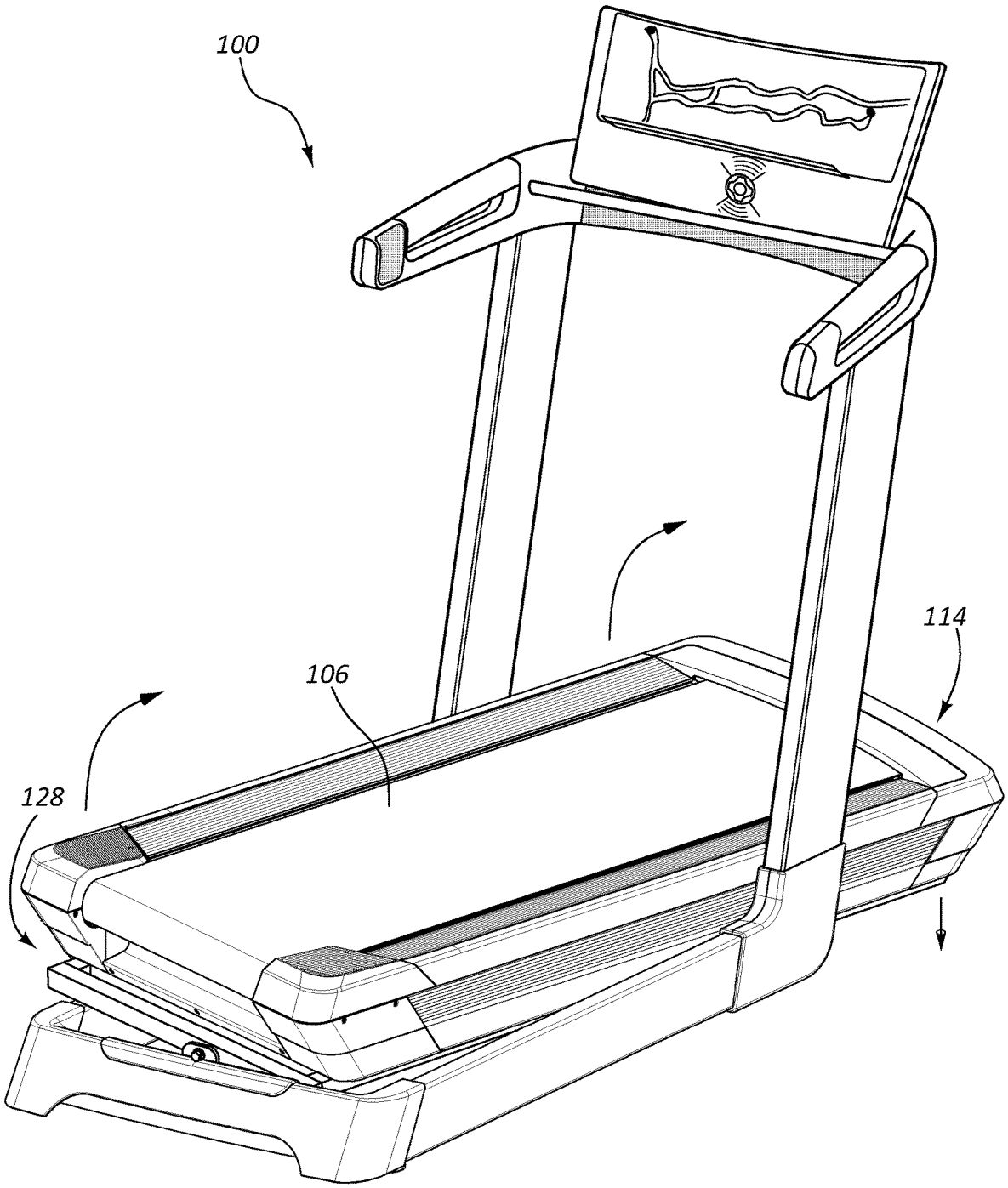
FIG. 6 illustrates a rear perspective view of the treadmill depicted in FIG. 1 with a running deck laterally tilted to a side and a rear portion of the deck elevated.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

FIGS. 1-6 depict an example of a treadmill 100 having a deck 102 with a first pulley disposed in a first portion of the deck 102 and a second pulley incorporated into a second portion of the deck 102. A tread belt 104 surrounds the first pulley and the second pulley. A motor is in mechanical communication with either the first pulley or the second pulley. A cover 106 is superjacent the motor. The treadmill 100 includes an upright portion 124 that supports a console 126.

The deck 102 is positionable with a plurality of actuators 108. The actuators 108 are connected to the deck 102 and a base 110 of the treadmill 100. In this example, an actuator is at least located at each of the deck's four corners 112, 114, 116, 118. The deck can be inclined at a positive angle by extending the actuators located at the front corners 112, 114. In some cases, the actuators 108 located at the rear corners 116, 118 may be lowered to assist with inclining the deck 102. Also, the deck 102 may be declined at a negative angle by extending the actuators 108 located at the rear corners 116, 118. In some examples, the actuators at the front corners 112, 114 may be lowered to assist with declining the deck 102. Further, the deck 102 may be tilted in a first side direction by extending the actuators 108 located on a first side 120 of the deck 102. In some examples, the actuators 108 located at the second side 122 of the deck 102 may be lowered to assist with tilting the deck 102 in the first side direction. Additionally, the deck 102 may be tilted in a second side direction by extending the actuators 108 located at the second side 122 of the deck 102. In some examples, the actuators 108 associated with the second side 122 of the deck 102 may be lowered to assist with tilting the deck 102 in the second direction. In the example depicted in FIG. 1, the actuators are telescoping cylinder actuators.

The deck 102 may be laterally tilted with any appropriate tilting mechanism. In the illustrated figures, the deck 102 is supported on a chassis 130 that is pivotally connected to a base 132 along a central axle 134 of the chassis 130. A first linear actuator 200 is connected to a first side 138 of the chassis 130, and a second linear actuator 202 is connected to a second side 142 of the chassis 130. As the first linear actuator 200 extends, the first side 138 of the deck 102 rises causing the lateral tilt angle 201 to change. Likewise, as the second linear actuator 202 extends, the second side 142 of the deck 102 rises causing the lateral tilt angle 201 to change. Retracting either the first or second linear actuators 200, 202 also causes the lateral tilt angle 201 to change. In some examples, either the first or the second linear actuator 200, 202 extends while other linear actuator is simultaneously retracted to create the desired lateral tilt angle 201. In other examples, the linear actuators 200, 202 are controlled to adjust the elevation of just one side of the deck 102 at a time.

In some examples, a chassis end 204 of the linear actuators 200, 202 is connected to the chassis 130, and a base end 206 of the linear actuators 200, 202 is connected to the base 132. Each actuator connection may include a pivot 208 so that the orientation of the linear actuators 200, 202 may move as the deck changes orientations. But, any appropriate type of actuator connection to the base and/or the deck 102, may be used in accordance with the principles described herein. Further, while the example illustrated in FIGS. 1-6 depict a single linear actuator on each of the first side 138 and second side 142, any appropriate number of linear actuators on each side may be used to cause the deck 102 to tilt. For example, multiple linear actuators may be evenly distributed along the length of either or both of the first side 138 and second side 142 to support the weight of the deck 102. In others examples, an additional linear actuator is positioned at a location along the length of either or both of the first and second side 138, 142 to correspond where the user's weight is likely to be loaded to the deck 102. In some examples, the linear actuators may be attached to tracks of the chassis 130 and of the base 132 so that the linear actuators can slide along the lengths of the first and/or second sides 138, 142 to appropriate position the linear actuators at those locations along the first and second sides 138, 142 based on where the user's weight is actually being loaded to the deck 102. Further, the treadmill 100 may incorporate at least one stand upon which the deck 102 can rest. In this example, the linear actuators can lift the appropriate side of the deck 102 to the appropriate height, and the stands can help hold the weight of the deck 102 in place while the lateral tilt angle 201 is being maintained.

The deck 102 may also have the capability of adjusting the height of both its front portion 114 and rear portion 128. For example, a motor may be positioned in the front portion 114 of the deck 102 that can adjust the height of the front portion 114 to cause the deck 102 to be sloped at an incline. Further, another motor may be positioned at the rear portion 128 to adjust the height of the rear portion 128 to cause the deck 102 to be sloped at a decline. While this example has been described with reference to independent mechanisms for independently lowering and raising the front portion 114 and the rear portion 128, these height adjustments may be executed with a single mechanism. For example, a height adjustment mechanism positioned in the front portion 114 of the deck 102 may include a height adjustment range sufficient to lower the front portion 114 so that the deck is brought into a declining orientation. Continuing with the same example, the same height adjustment mechanism may also raise the front portion 114 high enough to orient the deck 102 in an incline.

Figure 7:
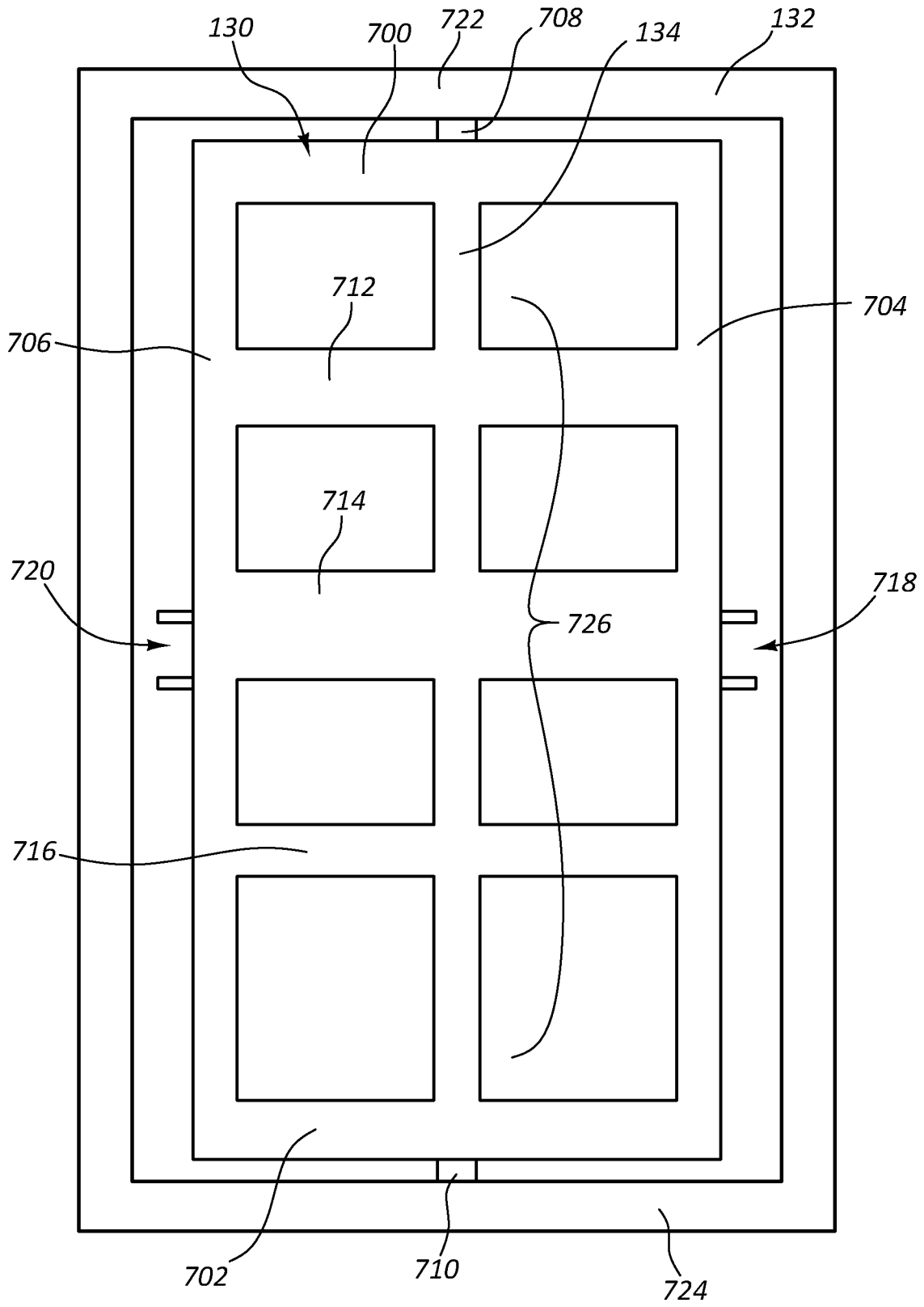
FIG. 7 illustrates a top view of an example of a chassis and base in accordance with the present disclosure.

FIG. 7 illustrates a top view of an example of a chassis 130 and base 132 in accordance with the present disclosure. In this example, the chassis 130 forms a rectangular perimeter with a front beam 700, a rear beam 702, a first side beam 704, and a second side beam 706. The central axle 134 runs through the middle of the chassis 130 intersecting the front beam 700 and the rear beam 702. Further, a front end 708 of the central axle 134 extends beyond the front beam 700, and a rear end 710 of the central axle 134 extends beyond the rear beam 702. The front end 708 and the rear end 710 are connected to the base 132. The connection may allow for rotational movement between the central axle 134 and the base 132. As a result, the chassis 130 can rotate or pivot about the central axle 134 as the linear actuators 200, 220 move the first and second sides 138, 142 of the chassis 130 up and down. An example of a rotary connection between the base 132 and the central axle 134 may include that the front end 708 and the rear end 710 are inserted into openings formed in the base 132. These openings may include an appropriate width and an appropriate shape to allow the central axle 134 to rotate. But, any appropriate type of rotary or pivot connection between the central axle 134 and the base 132 may be used in accordance with the principles described in the present disclosure.

Additionally, cross bars 712, 714, 716 connect the first and second side beams 704, 706 to the central axle 134 to distribute the forces from the weight of the deck 102 and the movement of the linear actuators 200, 202 throughout the chassis. A first pair 718 of connection plates are attached to the first side beam 704, and a second pair 720 of connection plates are attached to the second side beam 706. These pairs 718, 720 of connection plates are shaped to receive a pivot rod (not shown) which can connect with both plates of the pair. The chassis end 204 of the linear actuators 200, 202 can also attach to the pivot rods. Thus, the pivot rods can link the chassis 130 and the linear actuators 200, 202 together.

In the example of FIG. 7, the base 132 has a front section 722 that connects to the front end 708 of the central axle 134 and a rear section 724 that connects to the rear end of the central axle 134. The base 132 may connect to the chassis 130 or to central axle in any appropriate manner. For example, the base 132 may connect to a mid-section 726 of the central axle 134. In this example, the chassis 130 may include a longer length than the base 132. In yet other examples, the base 132 may include multiple independent components that collectively support the chassis 130 in this manner that the chassis 130 can incline, decline, and laterally tilt to appropriate position the deck 102 as desired.

In some examples, a linear actuator is attached to the front section 722 of the base 132. This linear actuator may move the base 132 to create an incline. Likewise, a linear actuator is attached to the rear section 724 of the base 132. This linear actuator may move the base 132 to create a decline. In some examples, just a portion of the front section 722 or the rear section 724 of the base 132 is movable to be reoriented to incline and/or decline the chassis 130 and therefore the deck 102.

Figure 8:
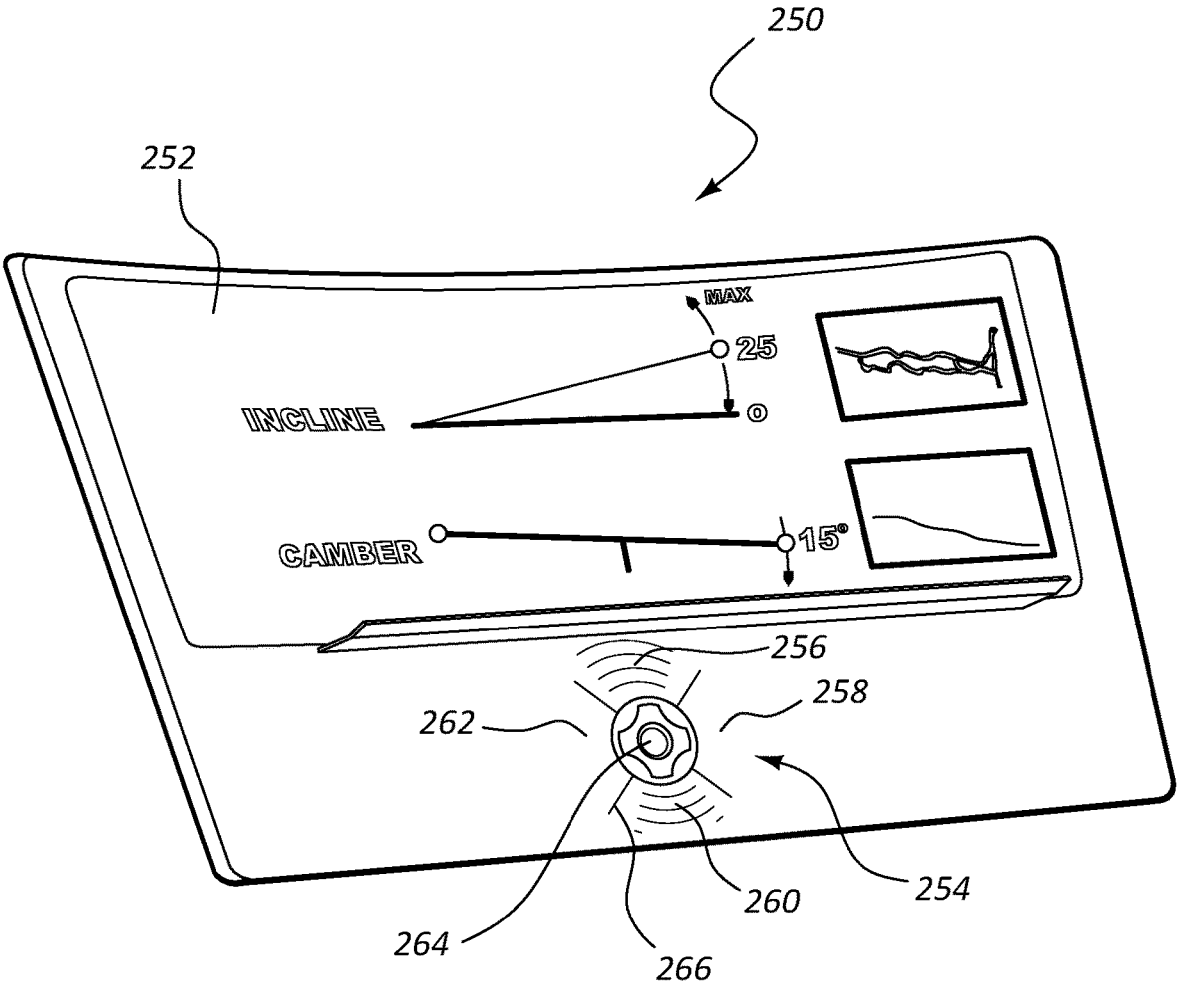
FIG. 8 illustrates a perspective view of an example of a console in accordance with the present disclosure.

FIG. 8 depicts an example of a console 250. In this example, the console 250 includes a display 252 and an input mechanism 254 that can be used to control the actuators that orient the treadmill's deck. In this example, the display 252 presents an image of a route being simulated with the treadmill.

The input mechanism 254 includes a 360-degree range, multi-dimensional input mechanism. In this example, the two dimensional input is a two dimensional input and is divided into four quadrants. A first quadrant 256 corresponds to controlling actuators located at the front portion of the treadmill, a second quadrant 258 corresponds to controlling actuators located at first side of the treadmill, a third quadrant 260 corresponds to controlling actuators located at a rear portion of the treadmill, and a fourth quadrant 262 corresponds to controlling actuators located at a second side of the treadmill. Further, the two dimensional input includes an input center 264. In the example depicted in FIG. 8, each of the quadrants 256, 258, 260, 262 are separated with a dividing line 266.

Figure 9:
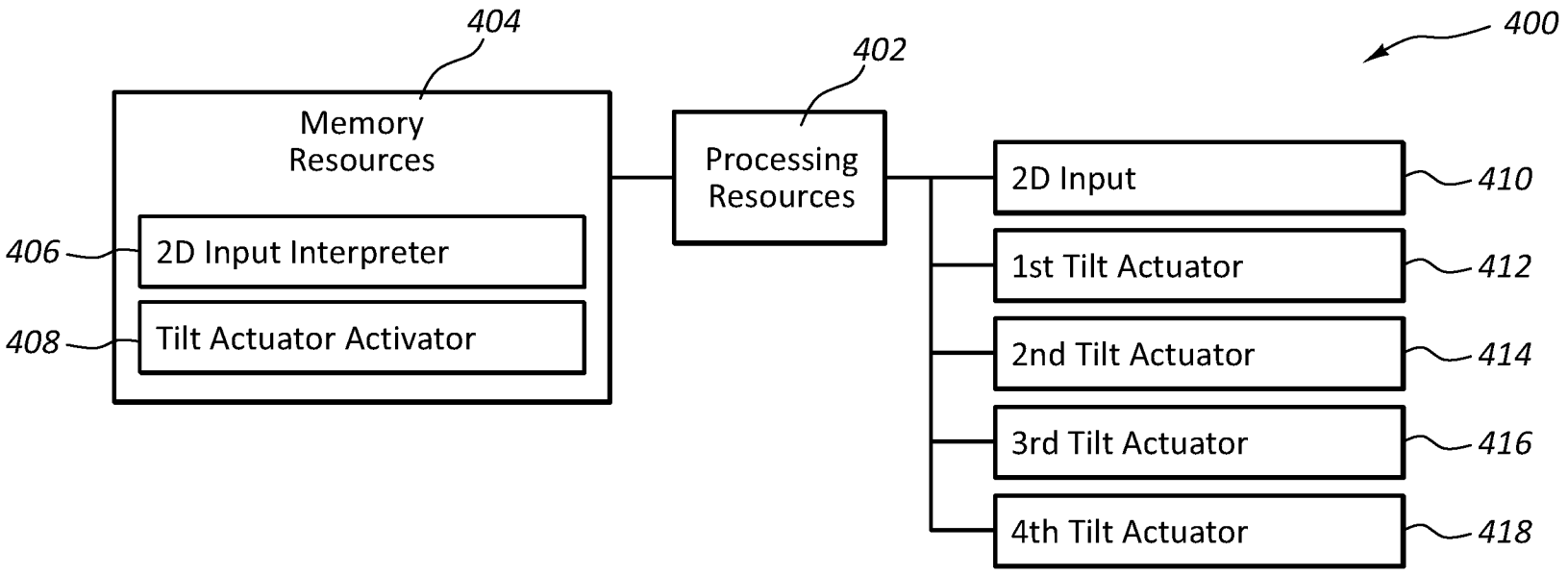
FIG. 9 illustrates a block diagram of an example of an actuation system in accordance with the present disclosure.

FIG. 9 depicts an example of an actuation system 400. In this example, the actuation system 400 includes processing resources 402 and memory resources 404. The memory resources 404 may cause the processing resources 402 to carry out functions programmed in the memory resources 404. In this example, the memory resources 404 include a multi-dimensional input interpreter 406 and a tilt actuator activator 408.

The processing resources 402 may be in communication with I/O resources, which may include a receiver, a transmitter, a transceiver, another type of communication device, or combinations thereof. Further, the processing resources 402 may be in direct communication or in communication through the I/O resources with a multi-dimensional input 410, a first tilt actuator 412, a second tilt actuator 414, a third tilt actuator 416, a fourth tilt actuator 418, or combinations thereof.

Figure 10:
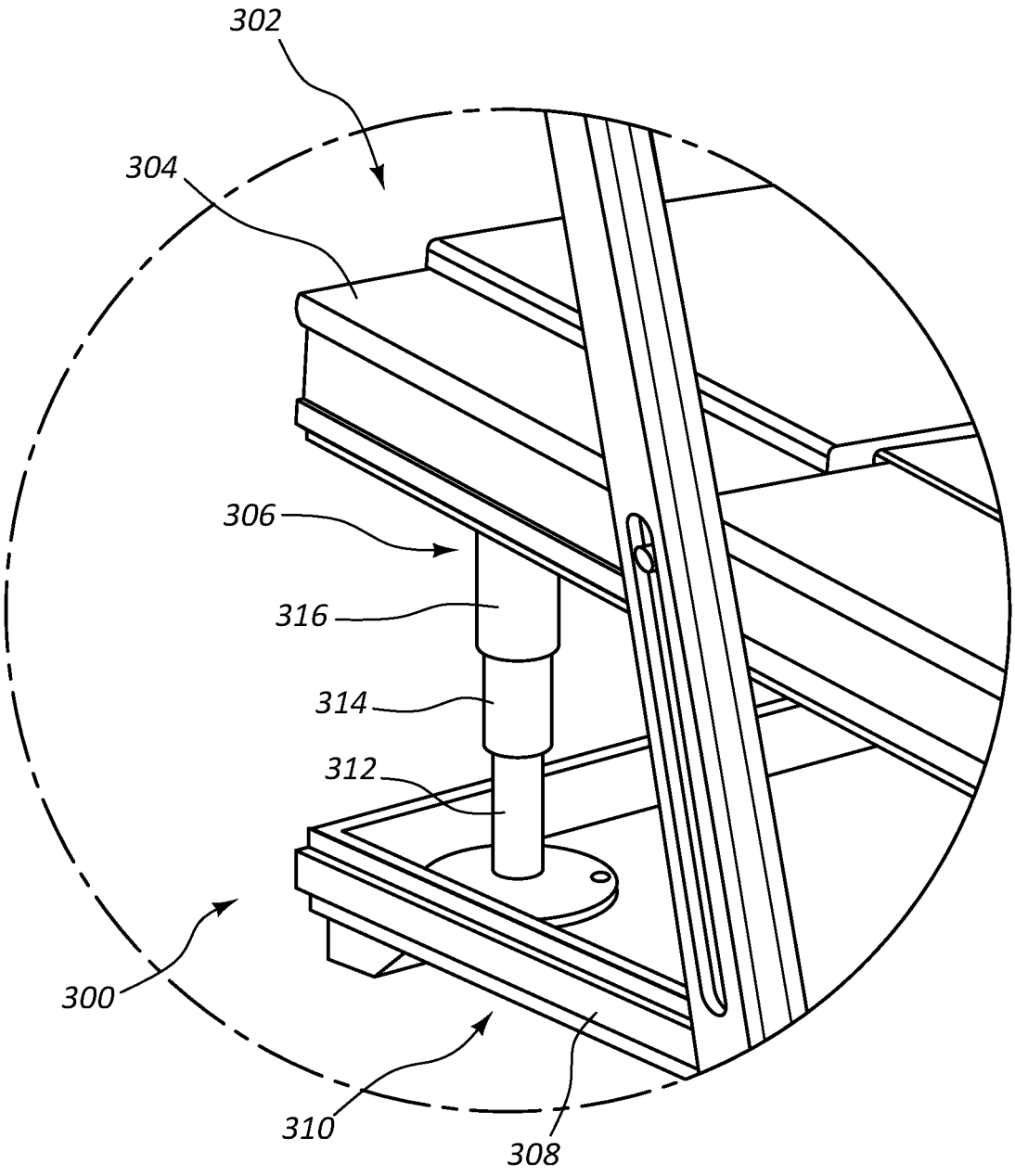
FIG. 10 illustrates a perspective view of an alternative example of an actuator in accordance with the present disclosure.

FIG. 10 depicts an alternative example of an actuator 300. The actuator 300 can be used to incline the treadmill deck 302, decline the treadmill deck 302, tilt the treadmill deck 302 to the side, or combinations thereof. In this example, the actuator 300 is connected to a platform 304 of the deck 302 at a first actuator end 306 and also connected to a base 308 at a second actuator end 310. The actuator 300 include a rod 312, an intermediate sleeve 314, and an outer sleeve 316 that telescopingly expands. In some cases, the actuator is hydraulically controlled, pneumatically controlled, magnetically controlled, or otherwise controlled to expand the rod and sleeves of the actuator.

Figure 11:
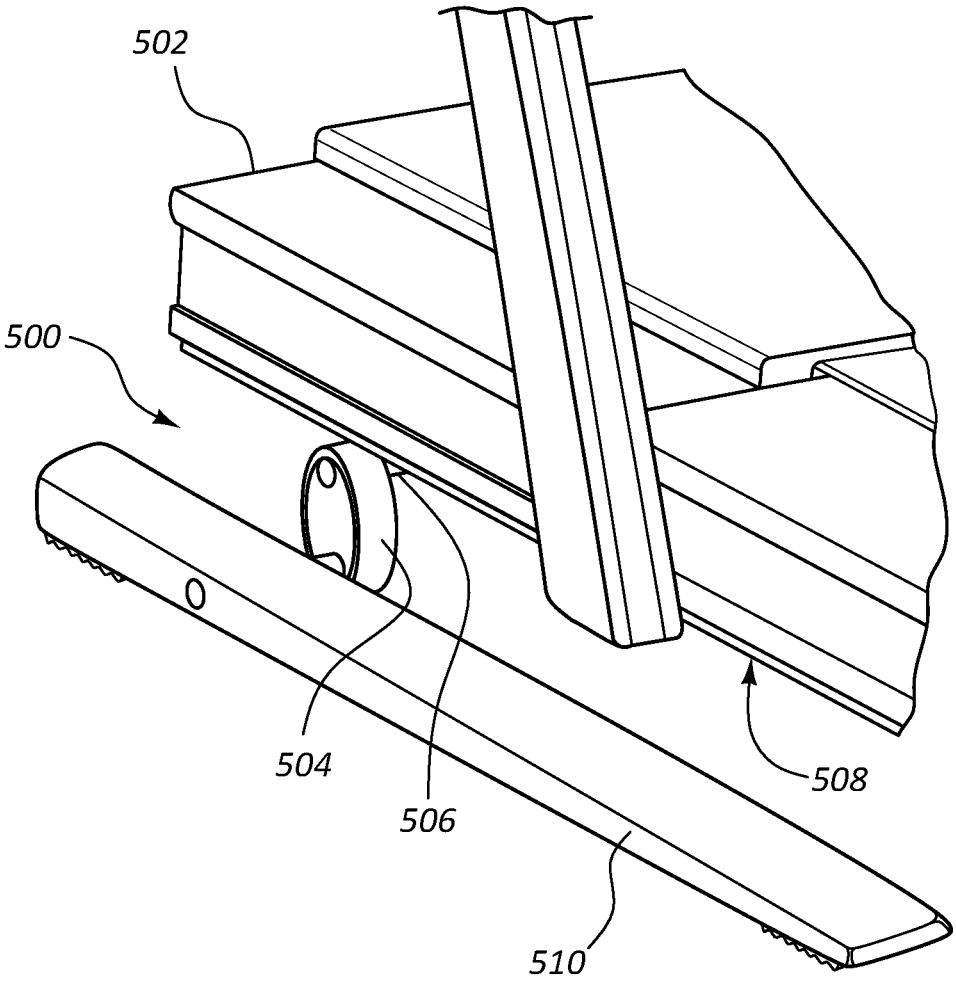
FIG. 11 illustrates a perspective view of an alternative example of an actuator in accordance with the present disclosure.

FIG. 11 depicts an example of an actuator 500. The actuator 500 can be used to incline the treadmill deck 502, decline the treadmill deck 502, tilt the treadmill deck 502 to the side, or combinations thereof. In this example, the actuator 500 includes a cam surface 504 that is connected to a shaft 506 that is located proximate the underside 508 of the deck 502. As the shaft 506 rotates, the cam surface 504 pushes off of the base 510 thereby causing the deck 502 to be reoriented.

Figure 12:
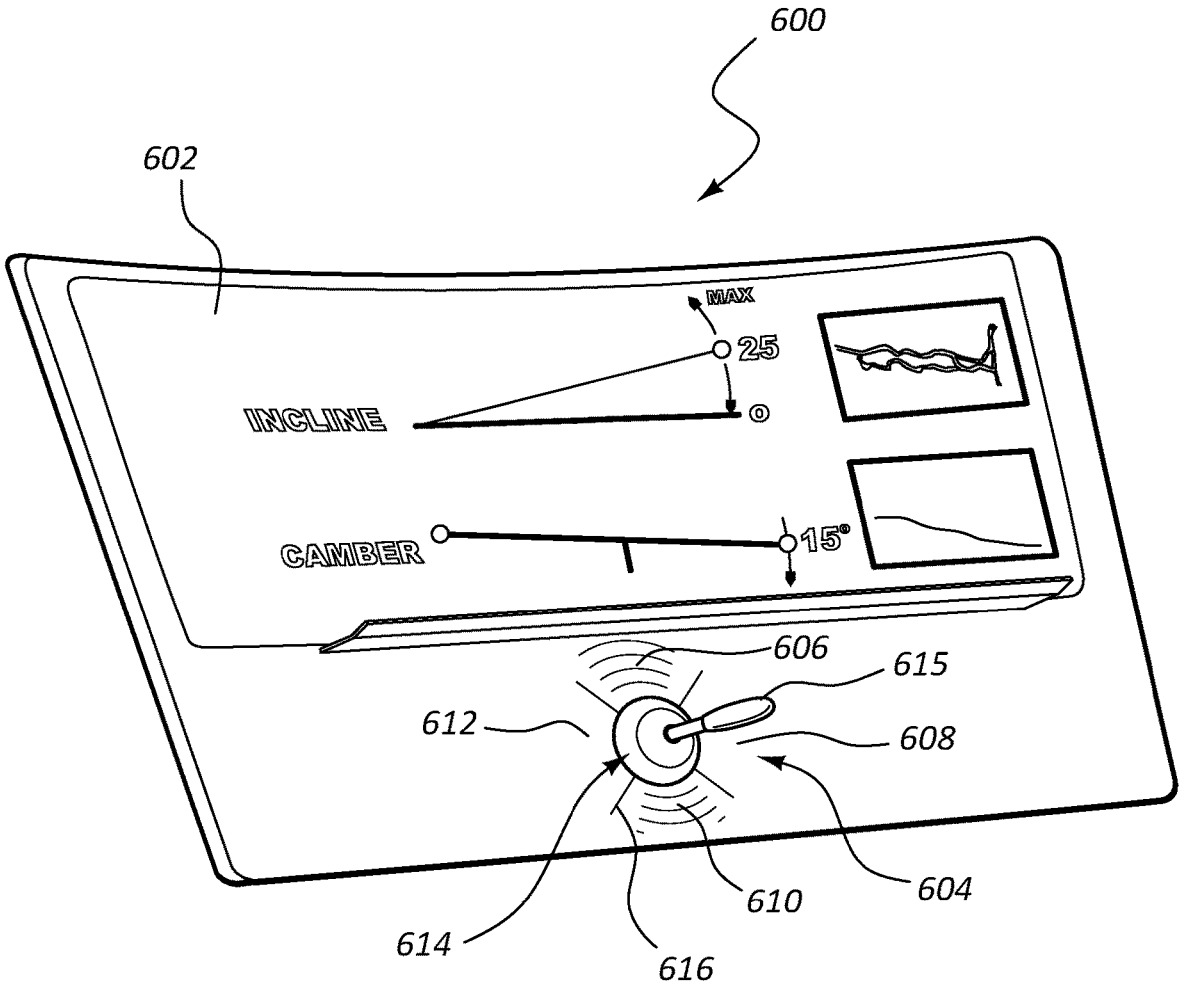
FIG. 12 illustrates a perspective view of an example of a console in accordance with the present disclosure.

FIG. 12 depicts an example of a console 600. In this example, the console 600 includes a display 602 and an input mechanism 604 that can be used to control the actuators that orient the treadmill's deck. In this example, the display 602 presents an image of a route being simulated with the treadmill.

The input mechanism 604 includes a 360-degree range, multi-dimensional input. In this example, the multi-dimensional input is a two dimensional input and is divided into four quadrants. A first quadrant 606 corresponds to controlling actuators located at the front portion of the treadmill, a second quadrant 608 corresponds to controlling actuators located at first side of the treadmill, a third quadrant 610 corresponds to controlling actuators located at a rear portion of the treadmill, and a fourth quadrant 612 corresponds to controlling actuators located at a second side of the treadmill. Further, the two dimensional input includes an input center 614. A joystick lever 615 is attached to the console 600 at the input center 614. In the example depicted in FIG. 12, each of the quadrants 606, 608, 610, 612 are separated with a dividing line 616.

Figure 13:
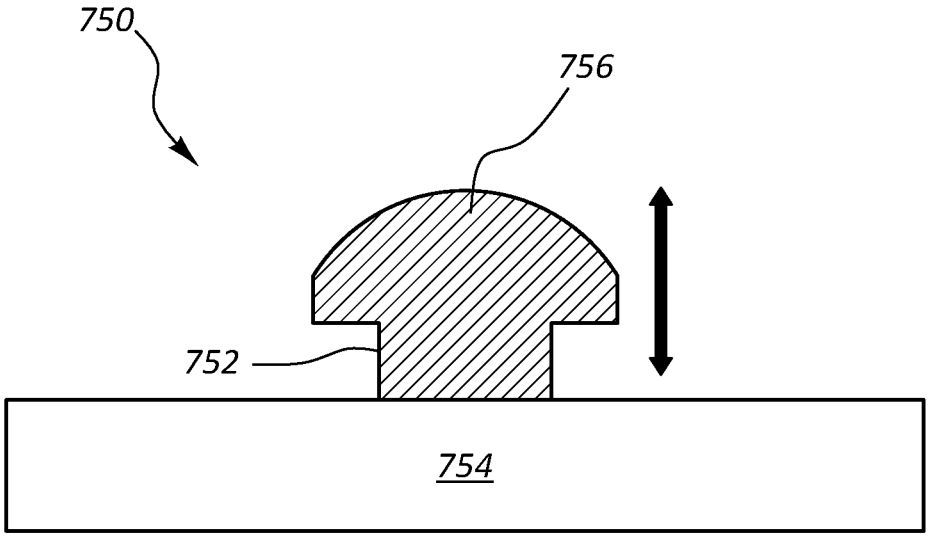
FIG. 13 illustrates a cross sectional view of an example of a multi-dimensional input mechanism in accordance with the present disclosure.
Figure 14:
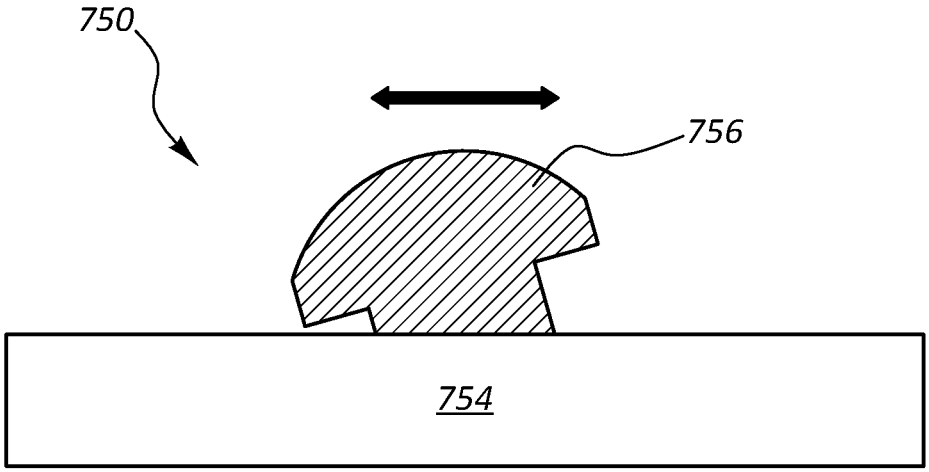
FIG. 14 illustrates a cross sectional view of an example of a multi-dimensional input mechanism in accordance with the present disclosure.

FIGS. 13 and 14 depict examples of a multi-dimensional input 750. In these examples, the multi-dimensional input 750 includes a joy stick 752 movably connected to the console 754. The multi-dimensional input includes the 360 degree range of motion within the two dimensional area of the console 754. Additionally, the input 750 includes a third dimension of control where the joy stick is movable in a direction transverse to the area of the console 754. Moving the head 756 of the joy stick in direction within the two dimensional area may select which actuators move or determine the amount that the actuators move while the transverse dimension may determine whether the actuators extend or contract. Additionally, a plurality of sensors (not shown) may be incorporated into the console 704. The plurality of sensors are configured to detect relative movement of the joy stick 702, generate signals representative of the detected relative movement, and transmit the generated signals to the processing resources 402.

GENERAL DESCRIPTION

In general, the invention disclosed herein may provide users with a treadmill that can adjust the lateral tilt angle and incline angle of the treadmill's exercise deck. The treadmill may include an upright structure and an exercise deck. A console may be attached to the upright structure. The console may include a display screen and input mechanisms for controlling operating parameters of the treadmill. One of the parameters that may be controlled through the console includes the orientation of the exercise deck.

The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power. In these situations, the tread belt may move as the user pushes off of the tread belt with his or her feet while walking or running. A flywheel may be connected to the tread belt and/or one of the pulleys to maintain the tread belt's momentum under the user's power.

The exercise deck may be capable of having its front portion raised and lowered as well as its rear portion raised and lowered to control the lengthwise slope of the running deck. With these orientation controls, the orientation of the running deck can be adjusted as desired by the user or as instructed by a programmed workout. In those examples where the treadmill is involved with simulating a route that involves changes in elevation, the running deck can be oriented to mimic the elevation changes in the route.

The lengthwise slope and/or lateral tilt angle of the exercise deck can be controlled with one or more actuators, often linear actuators, positioned at the corners of the deck. Other types of actuators may be used, such as cam surfaces, magnets, hydraulic actuators, pneumatic actuators, screw actuators, worm gears rack and pinion actuators, pulley and cable actuators, solenoids, piezoelectric actuators, servomechanisms, screw jacks, other types of actuators, or combinations thereof. Thus, in response to determining that the running deck's orientation should change, a signal can be sent to the actuators to appropriately move the deck into the desired orientation. The signal may come from the user's input, a simulated environment, a programmed workout, a remote device, another type of device or program, or combinations thereof.

In some examples, the deck may be laterally tilted with any appropriate tilting mechanism. The deck may be supported on a chassis that is pivotally connected to a base along a central axle of the chassis. A first linear actuator is connected to a first side of the chassis, and a second linear actuator is connected to a second side of the chassis. As the first linear actuator extends, the first side of the deck rises causing the lateral tilt angle to change. Likewise, as the second linear actuator extends, the second side of the deck rises causing the lateral tilt angle to change. Retracting either the first or second linear actuators also causes the lateral tilt angle to change. In some examples, either the first or the second linear actuator extends while other linear actuator is simultaneously retracted to create the desired lateral tilt angle. In other examples, the linear actuators are controlled to adjust the elevation of just one side of the deck at a time.

In some examples, a chassis end of the linear actuators is connected to the chassis, and a base end of the linear actuators is connected to the base. Each actuator connection may include a pivot so that the orientation of the linear actuators may move as the deck changes orientations. But, any appropriate type of actuator connection to the base and/or the deck, may be used in accordance with the principles described herein. Any appropriate number of linear actuators on each side may be used to cause the deck to tilt. For example, multiple linear actuators may be evenly distributed along the length of either or both of the first side and second side to support the weight of the deck. In others examples, an additional linear actuator is positioned at a location along the length of either or both of the first and second side to correspond where the user's weight is likely to be loaded to the deck. In some examples, the linear actuators may be attached to tracks of the chassis and of the base so that the linear actuators can slide along the lengths of the first and/or second sides to appropriate position the linear actuators at those locations along the first and second sides based on where the user's weight is actually being loaded to the deck. Further, the treadmill may incorporate at least one stand upon which the deck can rest. In this example, the linear actuators can lift the appropriate side of the deck to the appropriate height, and the stands can help hold the weight of the deck in place while the lateral tilt angle is being maintained.

The chassis may include any appropriate type of structural shape. For example, the chassis may form a rectangular perimeter on which the deck can be secured. In some examples, a central axle may bifurcate or otherwise divide the rectangular perimeter. In this example, the central axle may be pivotally connected to the base so that when either the first or the second linear actuator changes their height to change the lateral tilt angle of the deck that the chassis, and therefore the deck, pivot about the central axle. In other examples, the chassis has a front beam and a rear beam that are pivotally attached to the base. The structure of the chassis may also include a solid structure, multiple trusses, other types of supports, other types of structures, or combinations thereof.

In some examples, the base is part of the treadmill's frame and is integrally connected to the frame posts that support the control console. In other examples, the base may be independent of the treadmill's frame.

The deck may also have the capability of adjusting the height of both its front portion and rear portion. For example, a motor may be positioned in the front portion of the deck that can adjust the height of the front portion to cause the deck to be sloped at an incline. Further, another motor may be positioned at the rear portion to adjust the height of the rear portion to cause the deck to be sloped at a decline. While this example has been described with reference to independent mechanisms for independently lowering and raising the front portion and the rear portion, these height adjustments may be executed with a single mechanism. For example, a height adjustment mechanism positioned in the front portion of the deck may include a height adjustment range sufficient to lower the front portion so that the deck is brought into a declining orientation. Continuing with the same example, the same height adjustment mechanism may also raise the front portion high enough to orient the deck in an incline.

Regardless of the type of inclining and/or declining mechanisms incorporated into treadmill, these height adjustment mechanisms may incline or decline the deck at any appropriate slope. For example, the range of the deck's lengthwise slope may range from negative 60 degree to positive 60 degrees or any range there between.

While the above described examples have been described with reference to a treadmill with a deck that can change its lengthwise slope and lateral tilt angle in response to instructions from a workout program simulating a route, the lengthwise slope and lateral tilt angle may be adjusted in response to any appropriate source of instructions. For example, the control console may include input mechanisms for the user to instruct the treadmill to change the lengthwise slope or the lateral tilt angle at the user's request independent of a simulation program.

In some examples, the chassis forms a rectangular perimeter with a front beam, a rear beam, a first side beam, and a second side beam. The central axle runs through the middle of the chassis intersecting the front beam and the rear beam. Further, a front end of the central axle extends beyond the front beam, and a rear end of the central axle extends beyond the rear beam. The front end and the rear end are connected to the base. The connection may allow for rotational movement between the central axle and the base. As a result, the chassis can rotate or pivot about the central axle as the linear actuators move the first and second sides of the chassis up and down. An example of a rotary connection between the base and the central axle may include that the front end and the rear end are inserted into openings formed in the base. These openings may include an appropriate width and an appropriate shape to allow the central axle to rotate. But, any appropriate type of rotary or pivot connection between the central axle and the base may be used in accordance with the principles described in the present disclosure.

Additionally, in some cases the chassis may include cross bars that connect the first and second side beams to the central axle to distribute the forces from the weight of the deck and the movement of the linear actuators throughout the chassis. A first pair of connection plates are attached to the first side beam, and a second pair of connection plates are attached to the second side beam. These pairs of connection plates are shaped to receive a pivot rod which can connect with both plates of the pair. The chassis end of the linear actuators can also attach to the pivot rods. Thus, the pivot rods can link the chassis and the linear actuators together.

The base may have a front section that connects to the front end of the central axle and a rear section that connects to the rear end of the central axle. The base may connect to the chassis or to central axle in any appropriate manner. For example, the base may connect to a mid-section of the central axle. In this example, the chassis may include a longer length than the base. In yet other examples, the base may include multiple independent components that collectively support the chassis in this manner that the chassis can incline, decline, and laterally tilt to appropriate position the deck as desired.

In some examples, a linear actuator is attached to the front section of the base. This linear actuator may move the base to create an incline. Likewise, a linear actuator is attached to the rear section of the base. This linear actuator may move the base to create a decline. In some examples, just a portion of the front section or the rear section of the base is movable to be reoriented to incline and/or decline the chassis and therefore the deck.

In an alternative embodiment, the deck is positionable with a plurality of actuators at corners of the deck. The actuators are connected to the deck and a base of the treadmill. In this example, an actuator is located at each of the deck's four corners. The deck can be inclined at a positive angle by extending the actuators located at the front corners. In some cases, the actuators located at the rear corners may be lowered to assist with inclining the deck. Also, the deck may be declined at a negative angle by extending the actuators located at the rear corners. In some examples, the actuators at the front corners may be lowered to assist with declining the deck. Further, the deck may be tilted in a first side direction by extending the actuators located on a first side of the deck. In some examples, the actuators located at the second side of the deck may be lowered to assist with tilting the deck in the first side direction. Additionally, the deck may be tilted in a second side direction by extending the actuators located at the second side of the deck. In some examples, the actuators associated with the second side of the deck may be lowered to assist with tilting the deck in the second direction. In some examples, the actuators may be telescoping cylinder actuators.

In some cases, a first end of the actuator may be attached to the deck, and a second end of the actuators may be attached to a base of the treadmill. The deck may be movably attached to the base through the actuators. In some embodiments, the actuator includes a rod that can move relative to other portions of the actuator. In one case, the actuator is a single stage cylinder in which a single sleeve moves over the rod in a first direction to expand the length of the actuator or the sleeve moves in a second direction over the rod that is opposite of the first direction to reduce the length of the actuator. In some cases, the cylinder is a multi-stage cylinder, wherein intermediate sleeves and an outer sleeve move with respect to each other and the rod.

In some cases, the treadmill includes a console. The console may locate an input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the control console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The input mechanism for controlling the orientation of the treadmill's deck may include a multi-dimensional input. In some examples, the multi-dimensional input is a two dimensional, 360-degree input that can be used to orient the deck in multiple orientations. In some cases, the input mechanism can provide the user fine granularity for instructing the deck to orient in a purely lengthwise orientation, a side to side orientation, or an orientation that includes both lengthwise and side to side angles. The 360-degree, two dimensional input includes a touch screen, a joy stick, buttons, other inputs, or combinations thereof.

The two dimensional, 360-degree input may include a surface with an input center. An area around the input center can correspond to the corners and sides of the deck. In some cases, the area around the input center includes markings to provide the user visual references to which portions of the area correspond with the corners of the deck. For example, dividing lines may separate the area around the input center into quadrants. In some cases, the quadrants may correspond to a side of the deck, and the dividing lines correspond to the corners of the deck.

In examples where the quadrants correspond with the deck's sides, the user can instruct the deck to reorient by selecting the corresponding quadrant. For example, if the input mechanism is a touch screen, when a user touches within a quadrant that corresponds to the front of the deck, the actuators located at the front corners of the treadmill are caused to extend. The amount to which the front actuators extend may be dependent on how far away from the input center the user touches the input mechanism. In this case, the positive angle to which the actuators position the treadmill may depend on how far away from the input center that the user touches. In some cases, touching the input in just the front quadrant causes just the actuators associated with the front corners to extend, but in other examples touching within the first quadrant may also cause the actuators associated with the rear corners to lower to position the deck in a positive incline orientation.

Similarly, when a user touches within a quadrant that corresponds to the rear of the deck, the actuators located at the rear corners of the treadmill are caused to extend. The amount to which the rear actuators extend may be dependent on how far away from the input center the user touches the input mechanism. In this case, the negative angle to which the actuators position the treadmill may depend on how far away from the input center that the user touches. In some cases, touching the input in just the rear quadrant causes just the actuators associated with the rear corners to extend, but in other examples touching within the rear quadrant may also cause the actuators associated with the front corners to lower to position the deck in a negative incline orientation.

Additionally, each quadrant may have a location near the center that generates a signal for lowering the deck in the corresponding quadrant, while a location further from the center may generate a signal for raising the deck in the corresponding quadrant. In this manner, selective control of raising or lowering any quadrant of the treadmill can be finitely controlled by the user.

Likewise, when a user touches within a quadrant that corresponds to a first side of the deck, the actuators located at that side of the deck are caused to extend. The amount to which the side actuators extend may be dependent on how far away from the input center the user touches the input mechanism. In this case, the side to side angle to which the actuators position the treadmill may depend on how far away from the input center that the user touches. In some cases, touching the input in just the quadrant corresponding to just that side causes just the actuators associated with the first side corners to extend. In other examples, touching within the quadrant corresponding to the first side may also cause the actuators associated with the second side of the deck to lower to position the deck in the appropriate lateral tilt orientation.

The input mechanism may also allow the user to instruct the deck to orient in both a lengthwise slope and a side to side tilt orientation. The user may instruct the deck to move into this type of orientation by touching the screen at a designated area for slope and side tilt orientation, such as one of the lines that divides the quadrants. For example, if the user touches the screen at the line representing the front, right corner of the deck, the actuator located at the front, right corner may be reoriented. The front, left actuator may also be caused to expand, but not to the same degree as the front, right actuator. Similarly, the actuator at the rear, right corner may expand, but not to the same degree as the actuator at the front, right corner. In some cases, the rear, left corner may remain at the same elevation or reduce its elevation to position the deck at the appropriate angle. In this situation, the distance from the input center that the user touches along the dividing line may indicate the angle at which the deck is to be orientated. In this example, most, if not all, of the actuators move to orient the deck into the proper orientation.

The input mechanism may allow the user to select the angle of the deck based on the distance from the input center to the location on the input mechanism where the user touches the screen. The input mechanism may also allow the user to select the lengthwise vector and the side to side vector based on the azimuthal degree around the input center selected by the user. For example, if the user touches the screen at a 90-degree azimuthal angle, the deck may slope towards the first side of the deck. In other examples, the user may touch the screen at a 45-degree azimuthal angle causing the deck to orient in both a side to side tilt angle and also a lengthwise slope angle. In this example, with the selection of the 45-degree azimuthal angle, the deck's orientation has equal amounts of side to side tilt and lengthwise slope. In examples where the user selects a 30-degree azimuthal angle the deck may be oriented with more of a lengthwise component than a side to side component. In some embodiments, the user has an option of selecting any azimuthal angle between 0 degrees to 360 degrees. In other examples, the input mechanism may provide the user with just a subset of the 360-degree azimuthal angles.

A tracking locator may appear on the screen to identify for the user where the user touched and/or the location of the screen that represents the steepness angle and azimuthal angle of the exercise deck.

In some cases, the area around the input center is divided into arc segments or other types of sections, where each of the sections correspond to a location of the deck. In those circumstances where the user touches within these sections, the deck reorients the corresponding sections of the deck.

While the examples above have been described with reference to a multi-dimensional touch screen, the principles of a multi-dimensional input may be applied to other types of input mechanisms. For example, in one embodiment, a joy stick is positioned at the input center. The joy stick may be pushed towards an arc segment, a section, a quadrant, a dividing line, an azimuthal angle, or combinations thereof to select the portion of the deck to be reoriented. Elevating the selected portion of the deck may involve expanding multiple actuators and retracting others. In some cases, the activated actuators may be expanded at varying lengths to elevate the appropriate portion of the deck reorients to the proper height at the appropriate angle. The steepness of the orientation's angle may be determined based on how long the user holds the joy stick in the pushed or pulled position. In yet another example, buttons or other types of levers may be used to appropriately orient the deck.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to reorient to simulate the decline in the route. Also, if the route has a lateral tilt angle, the running deck may be tilted laterally to the appropriate side of the running deck to mimic the lateral tilt angle.

As the user begins to walk or run on the running deck, the display may change the scenery to mimic what the user would see if the user were actually at the real world location of the selected route. For example, a tree or another object located along the route that appears to be in the distance when the user is simulated to be at the beginning of the route may appear progressively closer as the user walks or runs on the running deck based on the speed at which the user is simulated to be traveling. Additionally, as the inclines and slopes of the simulated route change as the user progresses along the simulated route, the running deck can adjust to account for these terrain changes. For example, if the steepness of an uphill incline increases in the route, the running deck can likewise increase the incline of the running deck to mimic the change in steepness. Further, if the lateral angle of the route changes, the running deck can tilt laterally to one side to mimic the route's lateral angle.

While the programmed workout or the simulated environment may send control signals to orient the deck, the user may, in some instances, override these control signals by operating the multi-dimensional input. For example, if the programmed workout or the simulated environment cause the deck to be steeper than the user desires, the user can adjust the deck's orientation with the multi-dimensional input.

In some examples, the multi-dimensional input includes a third dimension of control where the joy stick is movable in a direction transverse to the area of the console. Moving the head of the joy stick in direction within the two dimensional area may select which actuators move or determine the amount that the actuators move while the transverse dimension may determine whether the actuators extend or contract. For example, if the user pulls up on the head of the joy stick and moves the joy stick towards the upper right corner of the two dimensional area, these movements may be interpreted to raise the upper right corner of the treadmill's deck. On the other hand, if the head of the joy stick is pushed downward towards the console, and the head is moved towards the upper right corner of the two dimensional area, these movements may be interpreted to lower the upper right corner. While these examples have been described with reference to specific movements being interpreted as being specific commands, these movements or other types of movements made with a three dimensional input mechanism may be interpreted to be any appropriate type of command.

In some examples, the input mechanism includes a zeroing mechanism that returns all the actuators to a starting position. In some examples, the starting position is a position where all of the actuators cause the deck to be level. The zeroing event may be triggered by pulling up or pushing down on the head of a joy stick when the joy stick is in a neutral position. In other examples, the input mechanism includes a button, and contacting the button triggers the zeroing event. While these examples have been described with specific triggers to initiating the zeroing event, any appropriate type of movement command, audible command, tactile command, or another type of command may be used to initiate the zeroing event.

Any appropriate type of actuator may be used in accordance with the principles described herein. For example, a non-exhaustive list of linear actuators that may be used as the first or second linear actuator includes screw actuators, hydraulic actuators, pneumatic actuators, solenoids, magnetic actuators, cams, electro-mechanical actuators, telescoping actuators, other types of linear actuators, other types of actuators, or combinations thereof. Further, the actuators may be powered with a motor, compressed gas, electricity, magnetic fields, other types power sources, or combinations thereof. Further, the actuators may also have the ability to laterally tilt the running deck to any appropriate angle formed between a running surface of the running deck and the surface upon which the treadmill rests. For example, the range of the lateral tilt angle may span from negative 55 degrees to positive 55 degrees measured from either the first side or the second side or any range there between.

Regardless of the type of inclining and/or declining mechanisms incorporated into treadmill, these height adjustment mechanisms may incline or decline the running deck at any appropriate slope. For example, the range of the running deck's lengthwise slope may range from negative 60 degree to positive 60 degrees or any range there between.

The actuation system for orienting the deck may include a combination of hardware and programmed instructions for executing the functions of the actuation system. The actuation system may include processing resources that are in communication with memory resources. Processing resources include at least one processor and other resources used to process the programmed instructions. As described herein, the memory resources may represent generally any memory capable of storing data such as programmed instructions or data structures used by the actuation system.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the system communicates with the remote device through a mobile device which relays communications between the actuation system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the actuation system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the actuation system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The processing resources may be in communication with the multi-dimensional input and be capable of receiving commands from the multi-dimensional input. Also, the processing resources may be in communication with a first tilt actuator, a second tilt actuator, a third tilt actuator, and a fourth tilt actuator. Each of these actuators may correspond to a corner of the deck or other portions of the deck.

The memory resources may include a multi-dimensional input interpreter that represents programmed instructions that, when executed, cause the processing resources to interpret the commands from the multi-dimensional input. For example, the user may select an azimuthal angle where the user touched the touch screen at a distance from the input center on the multi-dimensional input. The multi-dimensional input interpreter may determine the steepness of the orientation based on the distance that the user touched the screen from the input center. Also, the multi-dimensional input interpreter may determine the deck's orientation based on the azimuthal degree.

The memory resources may also include a tilt actuator activator that represents programmed instructions that, when executed, cause the processing resources to actuate the actuators to place the deck in the desired orientation. In some cases, all of the actuators that are to be repositioned are oriented simultaneously. In other cases, the actuators are actuated in an order.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. A treadmill, comprising:

an exercise deck, the exercise deck including:

a platform;

a first pulley incorporated into the platform at a front end;

a second pulley incorporated into the platform at a rear end;

a tread belt surrounding the first pulley and the second pulley;

a plurality of tilt actuators incorporated into the platform; and an upright structure, the upright structure including:

a console;

a tilt controller incorporated into the console in communication with each of the plurality of tilt actuators; and a multi-dimensional input mechanism associated with the tilt controller, wherein an input location on the multi-dimensional input mechanism corresponds with a tilt actuator of the plurality of tilt actuators located at a corresponding position on the platform.

2. The treadmill of claim 1, wherein the multi-dimensional input mechanism comprises a joy stick.

3. The treadmill of claim 1, further comprising:

a processor; and a memory;

wherein the memory includes programmed instructions that, when executed, cause the processor to interpret a multi-dimensional input signal into a corresponding tilt orientation of the exercise deck.

4. The treadmill of claim 3, wherein the programmed instructions, when executed, further cause the processor to activate at least one of the tilt actuators to position the exercise deck into the corresponding tilt orientation.

5. The treadmill of claim 3, wherein the multi-dimensional input signal comprises a section designator that correspond to a corresponding portion of the exercise deck;

wherein the programmed instructions, when executed, cause the processor to reorient the corresponding portion of the exercise deck when the tilt controller receives an input signal with the corresponding section designator.

6. The treadmill of claim 5, wherein the corresponding portion of the exercise deck is reoriented by extending or retracting at least one of the plurality of tilt actuators.

7. The treadmill of claim 3, wherein the multi-dimensional input signal is configured to selectively include a front left quadrant designator, a front right quadrant designator, a rear left quadrant designator, and a rear right quadrant designator.

8. The treadmill of claim 7, wherein the plurality of tilt actuators control an elevation of a front left portion of the exercise deck, a front right portion of the exercise deck, a rear left portion of the exercise deck, and a rear right portion of the exercise deck.

9. The treadmill of claim 1, wherein at least one of the plurality of tilt actuators comprises a linear actuator.

10. The treadmill of claim 1, wherein the multi-dimensional input mechanism comprises a touch screen.

11. The treadmill of claim 1, wherein the multi-dimensional input mechanism has a 360 degree range.

12. The treadmill of claim 1, further comprising a curved screen incorporated into the console.

13. The treadmill of claim 12, wherein the multi-dimensional input mechanism is incorporated into the curved screen.

14. A treadmill, comprising:

an exercise deck, the exercise deck including:

a platform;

a first pulley incorporated into the platform at a front end;

a second pulley incorporated into the platform at a rear end;

a tread belt surrounding the first pulley and the second pulley;

a plurality of tilt actuators incorporated into the platform; and an upright structure, the upright structure including:

a console;

a tilt controller incorporated into the console, wherein the tilt controller includes a multi-dimensional input mechanism;

a processor; and a memory;

wherein the memory includes programmed instructions that, when executed, cause the processor to:

interpret a multi-dimensional input at an input location on the multi-dimensional input mechanism into a corresponding tilt orientation of the exercise deck; and activate at least one corresponding tilt actuator of the plurality of tilt actuators to position the exercise deck into the corresponding tilt orientation based on the input location.

15. The treadmill of claim 14, wherein the multi-dimensional inputs comprise sections that correspond to portions of the exercise deck;

wherein the programmed instructions, when executed, cause the processor to reorient a portion of the exercise deck when the tilt controller receives an input associated with the portion.

16. The treadmill of claim 15, wherein the portion of the exercise deck is reoriented by extending or retracting at least one of the plurality of tilt actuators.

17. The treadmill of claim 14, wherein the multi-dimensional inputs include a front left quadrant, a front right quadrant, a rear left quadrant, and a rear right quadrant.

18. The treadmill of claim 17, wherein the plurality of tilt actuators control an elevation of a front left portion of the exercise deck, a front right portion of the exercise deck, a rear left portion of the exercise deck, and a rear right portion of the exercise deck.

19. The treadmill of claim 14, further comprising:

a curved screen incorporated into the console;

wherein the multi-dimensional input mechanism is incorporated into the curved screen.

20. A treadmill, comprising:

an exercise deck, the exercise deck including:

a platform;

a first pulley incorporated into the platform at a front end;

a second pulley incorporated into the platform at a rear end;

a tread belt surrounding the first pulley and the second pulley; and a plurality of tilt actuators incorporated into the platform; and an upright structure, the upright structure including:

a console;

a curved screen incorporated into the console;

a tilt controller including a multi-dimensional input mechanism incorporated into the curved screen;

wherein the multi-dimensional input mechanism includes sections that correspond to portions of the exercise deck;

a processor; and a memory, the memory including programmed instructions that, when executed, cause the processor to:

interpret a multi-dimensional input at an input location on the multi-dimensional input mechanism into a corresponding tilt orientation of the exercise deck; and activate at least one corresponding tilt actuator of the plurality of tilt actuators based on the input location to position the exercise deck into the corresponding tilt orientation by elevating the portion of the exercise deck when the tilt controller receives an input in the corresponding section;

wherein the corresponding portion of the exercise deck is reoriented by extending or retracting at least one of the plurality of tilt actuators and by retracting at least one of the plurality of tilt actuators.

* * * * *